US006054810A

United States Patent [19]

Yamamoto et al.

[11] Patent Number: 6,054,810

[45] Date of Patent: Apr. 25, 2000

[54] METAL HALIDE LAMP HAVING A CERAMIC DISCHARGE TUBE

[75] Inventors: Takashi Yamamoto, Takatsuki; Hiroshi Nohara, Kadoma; Shiki Nakayama, Ibaraki; Kouichi Sugimoto, Takatsuki; Kazuo Takeda, Sakai; Shigefumi Oda, Higashiosaka; Yoshiharu Nishiura, Otsu, all of Japan

[73] Assignee: Matsushita Electronics Corporation, Osaka, Japan

[21] Appl. No.: 09/004,743

[22] Filed: Jan. 8, 1998

[30] Foreign Application Priority Data

Apr. 18, 1997 [JP] Japan ..... 9-102170

[51] Int. Cl.[7] ..... H01J 61/06

[52] U.S. Cl. ..... 313/607; 313/623; 313/631; 315/50

[58] Field of Search ..... 313/607, 623, 313/624, 625, 626, 631, 634, 331, 332, 567; 315/50, 58, 59

[56] References Cited

U.S. PATENT DOCUMENTS

| | | | |
|---|---|---|---|
| 4,520,294 | 5/1985 | Iida et al. | 315/50 |
| 4,672,270 | 6/1987 | Ito et al. | 313/637 |
| 5,424,609 | 6/1995 | Geven et al. | 313/623 |
| 5,666,031 | 9/1997 | Jennato et al. | 313/637 |

FOREIGN PATENT DOCUMENTS

| | | |
|---|---|---|
| 0 085 487 A2 | 1/1983 | European Pat. Off. . |
| 0 562 680 A1 | 3/1993 | European Pat. Off. . |
| 60-236449 | 4/1985 | Japan . |
| 61-216232 | 9/1986 | Japan . |
| 03269945 | 12/1991 | Japan . |
| WO 98/07180 | 2/1998 | WIPO . |

*Primary Examiner*—Vip Patel
*Assistant Examiner*—Joseph Williams
*Attorney, Agent, or Firm*—Akin, Gump, Strauss, Hauer & Feld, L.L.P.

[57] ABSTRACT

A metal halide lamp of the present invention has a ceramic discharge tube and a proximity conductor disposed adjacent to the ceramic discharge tube.

14 Claims, 3 Drawing Sheets

METAL HALIDE LAMP HAVING A CERAMIC DISCHARGE TUBE

BACKGROUND OF THE INVENTION

The present invention relates to a metal halide lamp having a ceramic discharge tube.

A conventional metal halide lamp generally comprises a discharge tube having a pair of electrodes therein, an outer tube containing the discharge tube in the exhausted state or in a state being filled with an inert gas such as $N_2$-gas, stem wires leading out of the discharge tube in order to supply a current to the pair of electrodes in the discharge tube from a socket of an external lighting apparatus, and a current supply member configured in a base or the similar member and connected with ends of the stem wires outside the discharge tube.

The discharge tube is made of quartz glass having a transparent or translucent property. Further, in the conventional metal halide lamp, it is known that a ceramic material having a transparent or translucent property is used for the discharge tube as disclosed in unexamined and published Japanese patent application TOKKAI (Hei) No. 6-196131, for example.

A metal halide as a luminescent material, a rare gas such as Ar-gas for a start of a lighting operation and mercury are filled into the discharge tube. As concrete examples of the metal halide, there are sodium iodide, thallium iodide, and dysprosium iodide or the like. The conventional metal halide lamp emits a light having emission spectrum of visible region by combining a plurality of the above-mentioned metal halide. The conventional metal halide lamp is connected to an electric power source via a stabilizer. Accordingly, the current is limited so as not to exceed a predetermined value during the light operation.

Processes of the lighting operation in the conventional metal halide lamp are described as follows.

Firstly, a discharge is started caused by dielectric breakdown in both the rare gas and a vapor of the mercury, and thereby, temperatures on the inside walls of the discharge tube rise. According to the temperature rise, the metal halide filled into the discharge tube are vaporized. According to this vaporization of the metal halide, the light is radiated outside the discharge tube as light output with emission spectrum defined by vaporized metal atoms.

In the above-mentioned conventional metal halide lamp, at least one of the following methods (1) and (2) are selected and used in order to start and restart the lighting operation easily.

(1) The method of applying a pulse voltage for a starting operation to the pair of the electrodes by means of an igniter disposed outside the discharge tube.

(2) The method of coating the pair of the electrodes with an emitter material having a property of emission of electron and made of metal oxide compound such as barium oxide and scandium oxide.

However, in the case that the method (1) is used in the conventional metal halide lamp, it is strongly required that the pulse voltage is reduced as low as possible from the aspect of safety.

On the other hand, in the case that the method (2) is used in the conventional metal halide lamp, there occurs a problem that the luminescent material to be filled into the discharge tube is limited by the emitter material. Especially, it is impossible that rare earth metal compound such as dysprosium iodide is filled into the discharge tube as the luminescent material because the rare earth metal makes a chemical reaction with the emitter material.

Furthermore, in the conventional metal halide lamp, as a measure for reducing the above-mentioned pulse voltage, it has been suggested that a conductor made of molybdenum is disposed adjacent to the discharge tube as a proximity conductor. That is, in this suggestion, in order to start and restart the lighting operation easily, a predetermined electric potential is given to the proximity conductor from the electric power source, so as to prompt the dielectric breakdown in both the rare gas and the vapor of the mercury inside the discharge tube.

However, in the case that the proximity conductor is used in the conventional metal halide lamp, there is a possibility that the proximity conductor gives undesirable influence on the luminescent material in the discharge tube and therefore, the conventional metal halide lamp equipped with the proximity conductor can not be applied for practical use. The undesirable influence is that when the proximity conductor is used in the conventional metal halide lamp, a photoelectron is radiated from the proximity conductor owing to a large energy of rays including an ultraviolet ray. Thereby, an outer surface of the discharge tube is covered with the photoelectron, so that alkaline metal such as sodium leaks from the inside of the discharge tube to the outside thereof (i.e., to the inner space of the outer tube) through walls of the quartz glass. As a result, there occurs change of a color in the light output. Furthermore, a lamp voltage is increased during the lighting operation, and thereby, there is a problem that the conventional metal halide lamp can not be lit. With respect to the problem that the alkaline metal in the discharge tube leaks to the inner space of the outer tube, it appears regardless of the state in the outer tube. That is, the problem occurs not only in the exhausted state remarkably but also in the state being filled with $N_2$-gas.

BRIEF SUMMARY OF THE INVENTION

The object of the present invention is to provide a metal halide lamp that can solve the aforementioned problems in the conventional apparatus, can be configured with less cost and has a long life.

In order to achieve the above-mentioned object, a metal halide lamp comprises:

- a discharge tube made of a ceramic material and containing a pair of electrodes and at least metal halide as a luminescent material, and
- a proximity conductor either disposed adjacent to or come in contact with the discharge tube.

With this configuration, it is possible to prevent that alkaline metal in the discharge tube leaks from the inside of the discharge tube to the outside thereof through walls of the discharge tube made of the ceramic material. Furthermore, by using effect of the proximity conductor, the metal halide lamp can start and restart with a small pulse voltage (a pulse energy) easily, and further, it is possible to shorten times to be required at a start and a restart in a lighting operation. In addition, there is no emitter material coated on the pair of the electrodes in order to reduce the pulse voltage. Accordingly, metal halide including rare earth metal can be filled into the discharge tube as the luminescent material without limit due to a chemical reaction with the emitter material.

In the metal halide lamp of another aspect, the discharge tube and the proximity conductor are disposed in an outer tube having a translucent or transparent property either of the exhausted state or a state being filled with an inert gas.

With this configuration, the metal halide lamp can start and restart without coating the emitter material on the pair of the electrodes, and further, it is possible to shorten times to be required at the start and the restart in the lighting operation.

In the metal halide lamp of another aspect, one end part of the proximity conductor is fixed to a portion led outside the discharge tube of an outer lead member connected with one of the pair of electrodes, and the other end is disposed adjacent to the discharge tube.

With this configuration, the metal halide lamp can start and restart without coating the emitter material on the pair of the electrodes, and further, it is possible to shorten times to be required at the start and the restart in the lighting operation.

In the metal halide lamp of another aspect, the proximity conductor serves as a current supply wire for supplying a current to one of the pair of electrodes.

With this configuration, the metal halide lamp can start and restart without coating the emitter material on the pair of the electrodes, and further, it is possible to shorten times to be required at the start and the restart in the lighting operation.

In the metal halide lamp of another aspect, the proximity conductor is wound around the discharge tube.

With this configuration, the metal halide lamp can start and restart without coating the emitter material on the pair of the electrodes, and further, it is possible to shorten times to be required at the start and the restart in the lighting operation.

In the metal halide lamp of another aspect, the proximity conductor comes in contact with an outer surface of the discharge tube with at least one point.

With this configuration, the metal halide lamp can start and restart without coating the emitter material on the pair of the electrodes, and further, it is possible to shorten times to be required at the start and the restart in the lighting operation.

In the metal halide lamp of another aspect, the proximity conductor electrically insulates from a conductive member to be given an electrical potential and mounted to the discharge tube.

With this configuration, the metal halide lamp can start and restart without coating the emitter material on the pair of the electrodes, and further, it is possible to shorten times to be required at the start and the restart in the lighting operation.

In the metal halide lamp of another aspect, the metal halide contains at least one chemical element among sodium, lithium, potassium and cesium.

With this configuration, the metal halide lamp can start and restart without coating the emitter material on the pair of the electrodes, and further, it is possible to shorten times to be required at the start and the restart in the lighting operation. In addition, even when the proximity conductor is used in the metal halide lamp, it is possible to obtain a stable lamp characteristic during a predetermined life time without leakage of the alkaline metal outward the discharge tube.

In the metal halide lamp of another aspect, a translucent tube is disposed in the outer tube, and the discharge tube and the proximity conductor are disposed in the translucent tube.

With this configuration, the metal halide lamp can start and restart without coating the emitter material on the pair of the electrodes. Furthermore, it is possible to avoid to lengthen for restart time which becomes longer by mounting the translucent tube at the lighting operation, and further, to prevent the outer tube from receiving damage even if the discharge tube is broken.

In the metal halide lamp of another aspect, a pulse voltage is applied to the pair of electrodes at a start of a lighting operation, and said pulse voltage is a peak voltage of 2.5 kV or less and a pulse width of 0.5$\mu$ second or less at the peak voltage of 90%.

With this configuration, the metal halide lamp can start and restart without coating the emitter material on the pair of the electrodes, and further, it is possible to shorten times to be required at the start and the restart in the lighting operation.

BEST MODE FOR CARRYING OUT THE INVENTION

Hereafter, preferred embodiments of the present invention will be described with reference to the accompanying drawings.

<<FIRST EMBODIMENT>>

Figure 1:
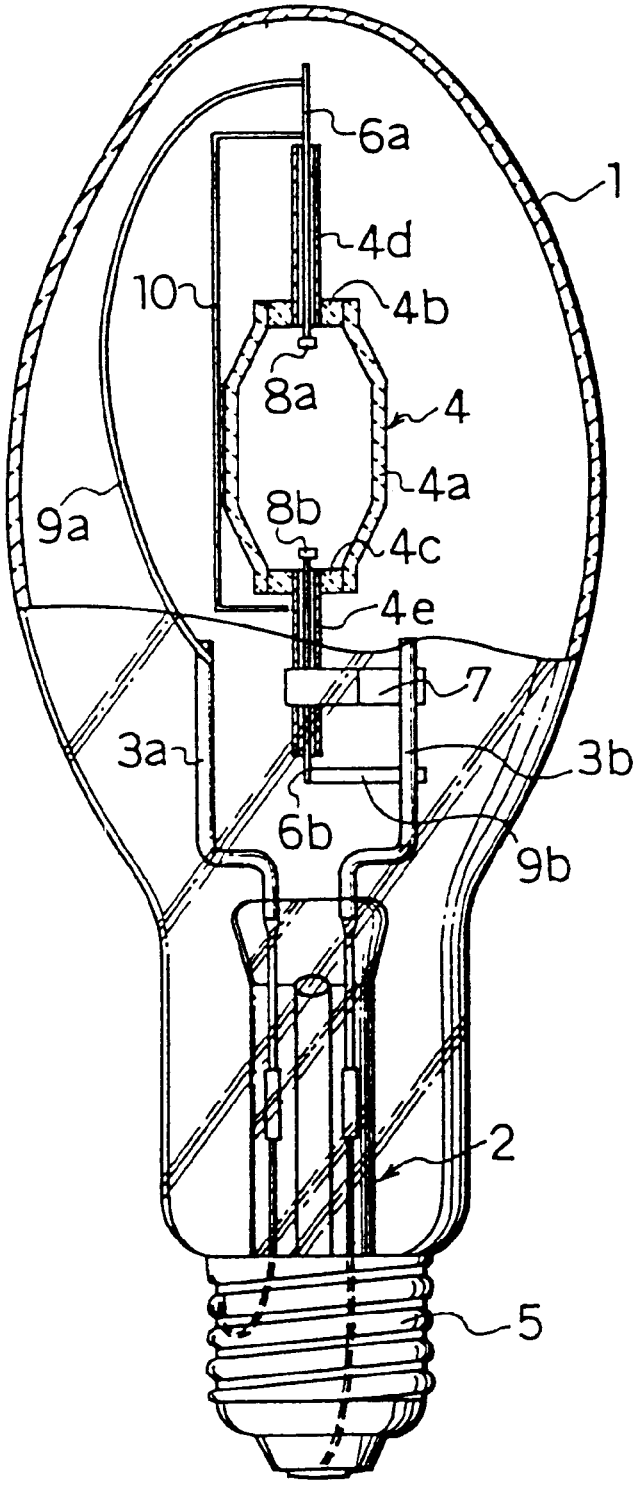
FIG. 1 is a partially cross-sectional view showing a configuration of a metal halide lamp in a first embodiment of the present invention.

FIG. 1 is a partially cross-sectional view showing a configuration of a metal halide lamp in a first embodiment of the present invention.

As shown in FIG. 1, a metal halide lamp of the present embodiment comprises an outer tube 1 having an opening at one end portion thereof, a stem insulator 2 disposed at the opening of the outer tube 1 to seal the outer tube 1, a pair of stem wires 3*a*, 3*b* supported by the stem insulator 2 to insulate from each other electrically, and a discharge tube 4 made of a ceramic material having a translucent or transparent property.

The outer tube 1 is made of glass having a translucent or transparent property. In the outer tube 1, $N_2$-gas is filled as an inert gas with a pressure of $1\times10^5$ pa, for example. A screw-shaped base 5 is disposed at one end part of the stem insulator on the sealed side of the outer tube 1. Each of one ends of the stem wires 3*a*, 3*b* is fixed to an inner surface of the base 5 by a solder or the similar member.

The base 5 is connected with a socket of an external lighting apparatus (not shown), and supplied an electric power from a stabilizer equipped with an igniter. The stem wires 3*a*, 3*b* are formed by a metal wire of molybdenum, nickel or the like.

The discharge tube 4 is configured with alumina-ceramic, and comprises a substantially cylindrical member 4*a* opened at both ends thereof, disk-shaped members 4*b*, 4*c* disposed at the respective ends of the cylindrical member 4*a* to seal the cylindrical member 4*a*, narrow tubes 4*d*, 4*e* fixed to the respective disk-shaped members 4*b*, 4*c*.

The narrow tubes 4*d*, 4*e* are formed with the respective disk-shaped members 4*b*, 4*c*, integratedly.

The disk-shaped members 4*b*, 4*c* are mounted to the respective ends of the cylindrical member 4*a* by a shrinkage fitting, so that the discharge tube 4 is sealed airtightly. Outer lead wires 6*a*, 6*b* are disposed in the narrow tubes 4*d*, 4*e*, respectively. The outer lead wires 6*a*, 6*b* are made of niobium, and fixed to the respective narrow tubes 4*d*, 4*e* with a glass frit.

The narrow tube 4*e* is supported and fixed to a discharge tube support plate 7 fixed to the other end part of the stem wire 3*b*. Thereby, the discharge tube 4 is disposed and supported at a predetermined position in the outer tube 1.

Metal halide as a luminescent material, Ar-gas as a rare gas for a start of a lighting operation, and mercury are filled into the discharge tube 4. It is preferable that the metal halide uses dysprosium iodide, holmium iodide, thulium iodide, sodium iodide, and/or thallium iodide. The metal halide lamp emits a light having emission spectrum of visible region by combining at least two kinds of the metal halide with each other.

A pair of electrodes 8*a*, 8*b* are disposed in the discharge tube 4, and connected with one ends of the outer lead wires 6*a*, 6*b*, respectively. The other ends of the outer wires 6*a*, 6*b* are connected with one ends of current supply wires 9*a*, 9*b* by a welding, respectively. The other ends of the current supply wires 9*a*, 9*b* are connected to the respective stem wires 3*a*, 3*b* by the welding, so that the electric power is supplied to the pair of the electrodes 8*a*, 8*b*.

One end of a proximity conductor 10 of molybdenum is fixed to one end part of the outer wire 6*a* by the welding. The other end of the proximity conductor 10 is disposed adjacent to the discharge tube 4. The proximity conductor 10 is given a predetermined electric potential with a pulse voltage to be applied at the start of the lighting operation, and thereby to prompt dielectric breakdown in both the rare gas and a vapor of the mercury in the discharge tube 4.

By mounting this proximity conductor 10, in the metal halide lamp, it is possible to reduce each the pulse voltage at the start and a restart of the lighting operation. Furthermore, in the metal halide lamp, it is possible to shorten times to be required at the start and the restart of the lighting operation.

In this embodiment, sodium is used for the metal halide, and lithium, potassium and cesium may be used for the metal halide.

As a predetermined voltage is applied to the metal halide lamp from the socket of the aforementioned lighting apparatus, the dielectric breakdown in both the rare gas and the vapor of the mercury, so that a discharge starts to generate between the pair of the electrodes 8*a*, 8*b* in the discharge tube 4. Hereafter, according to this discharge, temperatures on the inner walls of the discharge tube 4 are increased, and thereby, the metal halide is vapored.

As a result, a light is radiated as light output from the discharge tube 4 outward through the outer tube 1 with emission spectrum defined by filled and vapored metal atoms. The light output is maintained with the current from the stabilizer in a manner to obtain a stable lighting condition.

Subsequently, a lighting test of the metal halide lamp carried out by the present inventions will be explained. In this lighting test, the metal halide lamp of the present embodiment was lit by a use of a stabilizer of 150 W in which an igniter output the pulse voltage having a maximum pulse voltage (a peak voltage) of 2.5 kV and a pulse width of 0.5$\mu$ second at the peak voltage of 90% to the metal halide lamp. Further, in this lighting test, after the metal halide lamp was lit in the stable lighting condition, the metal halide lamp was left in an extinguished state for 6 hours or more continuously, and examined to find whether the metal halide lamp was lit within 2 second after the electric power was supplied to the metal halide lamp.

The lighting test was performed five times. As a result, in the lighting test, the metal halide lamp of the present embodiment was lit within 2 second after the electric power was supplied to the metal halide lamp at all the five times, and judged as non-defective lamp.

Furthermore, it was measured a necessary time to restart the lighting operation. The necessary time to restart the light operation was examined by means of measuring a time until the metal halide lamp was lit again from the extinguished state after the metal halide lamp was lit in the stable lighting operation sufficiently. The necessary time to restart the lighting operation was measured three times, and further, it was judged as the non-defective lamp in the case that the measured necessary time to restart the lighting operation was smaller than 10 minutes. As a result, at all the three times, the metal halide lamp of the present invention was restarted the lighting operation within 8 minutes after the electric power was supplied to the metal halide lamp.

In the above-mentioned lighting test, the reason why the pulse voltage was adjusted to 2.5 kV will be elucidated.

It is known that the pulse voltage to be applied to the metal halide lamp affects a shape of the base 5 and arrangement each of the current supply wires 9*a*, 9*b* in the outer tube 1. In the case that the screw-shaped base 5 is used in the metal halide lamp, it is required to limit the pulse voltage under 2.5 kV in view of dielectric strength thereof. Furthermore, in the case of the pulse voltage, it makes a difference in a pulse energy depending on a pulse width. As the pulse width becomes small, the pulse energy takes smaller and safety of the metal halide lamp is increased. Moreover, it is possible to design or select the igniter easily. In conclusion, when the metal halide lamp is started and lit with the pulse voltage having the pulse width of 0.5$\mu$ second at the peak voltage of 90%, it is possible to increase reliance about a lighting system including the igniter and other lighting members. Moreover, the metal halide lamp can be configured with less cost and sufficient merits. Therefore, the lighting test was performed with the above-mentioned pulse voltage (2.5 kV) and the pulse width (0.5$\mu$ second at the peak voltage of 90%) as maximum values.

Furthermore, according to the present inventors' experiments, it was confirmed that the metal halide lamp of the present embodiment can start and restart the lighting operation with the pulse voltage of 1.5 kV or more.

Furthermore, in the metal halide lamp of the present embodiment, a life test for 6000 hours was performed in order to confirm whether alkaline metal filled into the discharge tube 4 leaks from the inside of the discharge tube 4 to the outside thereof. As a result, in the metal halide lamp of the present embodiment, leakage of the alkaline metal was not found. Accordingly, in the metal halide lamp of the present embodiment, it was confirmed that the aforementioned problems in the prior art were solved. That is, in the metal halide lamp of the present embodiment, there is no occurrence of the leakage of the alkaline metal filled in the discharge tube 4 as mentioned in the above. Thereby, in the metal halide lamp of the present embodiment, it is possible to prevent change of a color in the light output caused by the leakage of the alkaline metal.

Furthermore, in the metal halide lamp of the present embodiment, it is possible to eliminate a lamp voltage from increasing, and as a result to avoid a problem that the metal halide lamp can not be lit. According to the present inventor's experiments, if the proximity conductor 10 is not attached to the metal halide lamp of the present embodiment, the metal halide lamp having no proximity conductor 10 once took 2 second or more to start the lighting operation. Furthermore, the necessary time to restart the lighting operation was longer than 10 minutes.

As has been explained in the above, in the metal halide lamp of the present embodiment, the discharge tube 4 are made of the ceramic material, and further the proximity conductor 10 is disposed adjacent to the discharge tube 4. Thereby, it is possible to prevent that alkaline metal in the discharge tube 4 leaks from the inside of the discharge tube 4 to the outside thereof. Furthermore, the metal halide lamp can start and restart with a small pulse voltage (a pulse energy) easily, and further, it is possible to shorten times to be required at the start and the restart in the lighting operation.

In addition, the aforementioned emitter material need not coat on the pair of the electrodes 8*a*, 8*b*, and thereby, metal halide including rare earth metal can be filled into the discharge tube 4 as the luminescent material without limit due to a chemical reaction with the emitter material.

Apart from the aforementioned explanation, wherein the proximity conductor 10 is disposed adjacent to the discharge tube 4, an alternately construction may be such that the proximity conductor 10 is disposed so as to come in contact with an outer surface of the discharge tube 4 with at least one point.

<<SECOND EMBODIMENT>>

Figure 2:
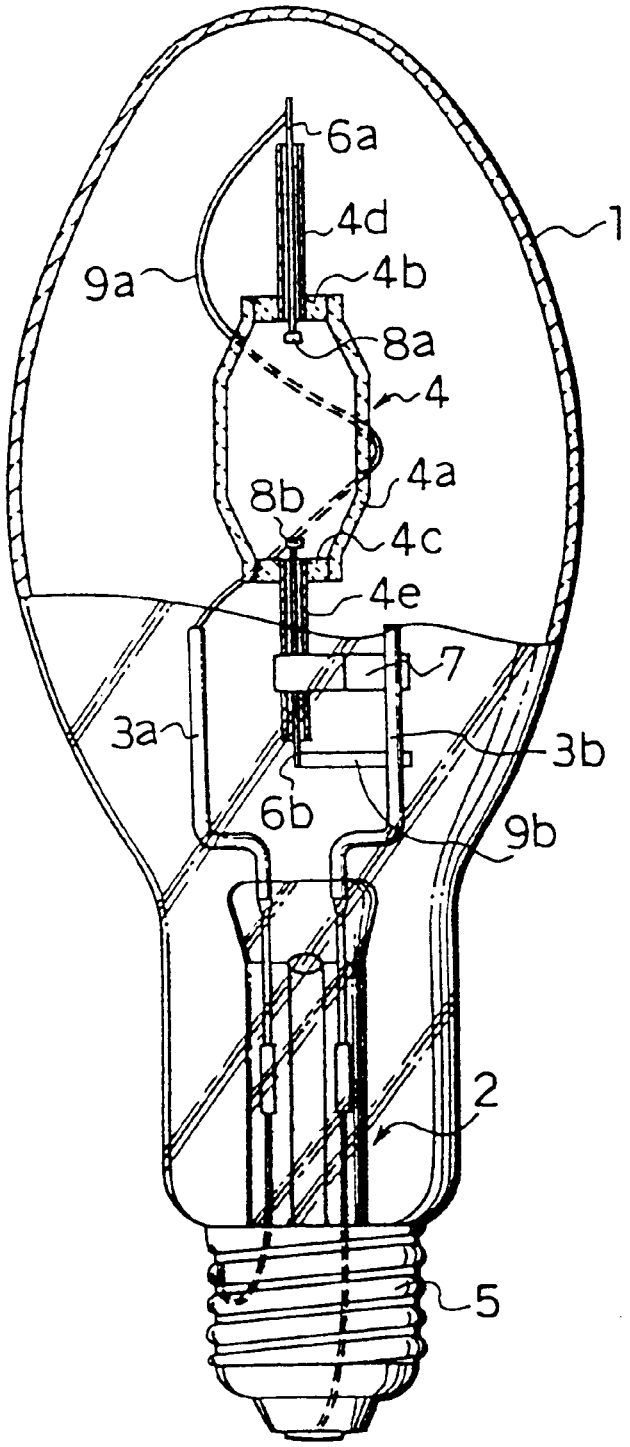
FIG. 2 is a partially cross-sectional view showing a configuration of a metal halide lamp in a second embodiment of the present invention.

FIG. 2 is a partially cross-sectional view showing a configuration of a metal halide lamp in a second embodiment of the present invention. According to the configuration of the metal halide lamp of the second embodiment, one of the two current supply wires is wound around the outer surface of the discharge tube, so that the one of the two current supply wires is also served as the proximity conductor. The other elements and portions are similar to those of the first embodiment and will not be described.

As shown in FIG. 2, one of the current supply wire 9*a* is wound around the outer surface of the discharge tube 4, and connected with the stem wire 3*a* and the outer lead wire 6*a*. The pulse voltage is applied to the current supply wire 9*a* at the start of the lighting operation, so that the current supply wire 9*a* serves as the proximity conductor 10 shown in FIG. 1. Therefore, the metal halide lamp of the present embodiment can start the lighting operation with the pulse voltage having the peak voltage of 2.5 kV or less and the pulse width of 0.5$\mu$ second or less at the peak voltage of 90%, as well as that of the first embodiment.

In the metal halide lamp of the present embodiment, the same test as the lighting test in the first embodiment was performed. As a result, the necessary times to start and restart the lighting operation were within 1 second and 5 minutes, respectively. In a resultant of the life test, there is no appearance that the alkaline metal such as sodium leaks from the inside of the discharge tube 4 to the inner space of the outer tube 1, and further, the lamp characteristics of the metal halide lamp were stable during a predetermined life time as well as that of the first embodiment.

<<THIRD EMBODIMENT>>

Figure 3:
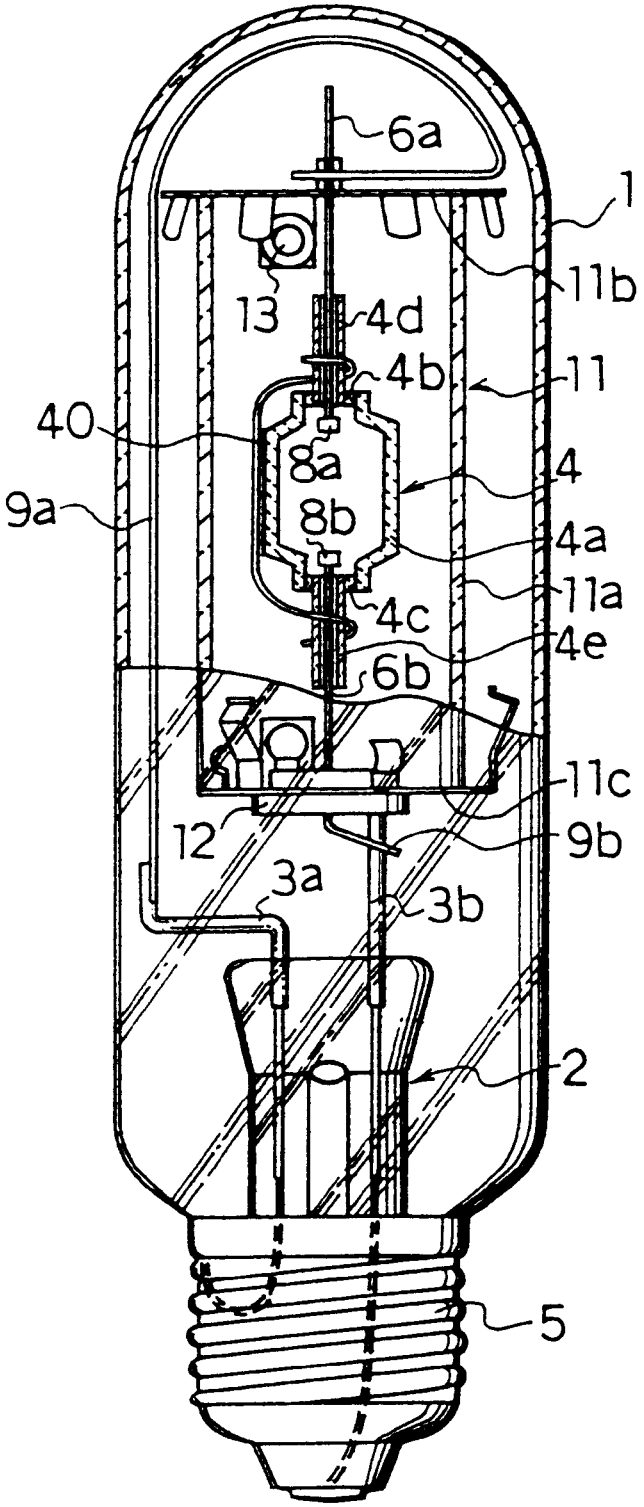
FIG. 3 is a partially cross-sectional view showing a configuration of a metal halide lamp in a third embodiment of the present invention.

FIG. 3 is a partially cross-sectional view showing a configuration of a metal halide lamp in a third embodiment of the present invention. According to the configuration of the metal halide lamp of the third embodiment, the discharge tube is contained in a tube having a translucent property, and disposed inner space the outer tube together with the tube. Furthermore, the proximity conductor is disposed adjacent to the discharge tube so as to electrically insulate from the outer lead wires without connecting thereto. The other elements and portions are similar to those of the first embodiment and will not be described.

As shown in FIG. 3, in the metal halide lamp of the third embodiment, the discharge tube 4 is disposed and contained in a translucent tube 11 made of quartz glass. The tube 11 has a cylindrical member 11*a* opened at both end portions thereof, and metal plates 11*b*, 11*c* disposed at the respective end portions of the cylindrical member 11*a* in order to seal the cylindrical member 11*a*. One end of the current supply wire 9*a* is connected with the outer lead wire 6*a*, and the other end is connected with the stem wire 3*a*. One end of the current supply wire 9*b* is connected with the outer lead wire 6*b*.

The current supply wire 9*b* is led out from the inner space of the tube 11 to the outside thereof through an insulative sleeve 12, and the other end is fixed to the stem wire 3*b* by the welding. Thereby, the tube 11 is disposed and supported at a predetermined position in the outer tube 1. In order to remove impurity gas of $O_2$-gas and $H_2$-gas in the tube 11, a getter 13 is mounted on surfaces of the metal plates 11*b*, 11*c* inside the tube 11.

Both end portions of the proximity conductor 40 are wound around the ceramic narrow tubes 4*d*, 4*e* containing the outer lead wires 6*a*, 6*b*, respectively. Further, the proximity conductor 40 is disposed adjacent to the discharge tube 4 and insulated from the outer lead wires 6*a*, 6*b* electrically. That is, the proximity conductor 40 has a capacitance coupling with the lead wires 6*a*, 6*b* via the narrow tubes 4*d*, 4*e*. Thereby, the proximity conductor 40 can prompt the dielectric breakdown in both the rare gas and the vapor of the mercury in the discharge tube 4 as well as the proximity conductor 10 of the first and second embodiments. As a result, in the metal halide lamp of the present embodiment, it is possible to reduce the pulse voltage at the start and the restart, and to shorten the necessary times to start and restart the lighting operation.

In the metal halide lamp of the present embodiment, the same test as the lighting test in the first embodiment was performed. As a result, the necessary times to start and restart the lighting operation were within 1 second and 5 minutes, respectively. In a resultant of the life test, there is no appearance that the alkaline metal such as sodium leaks from the inside of the discharge tube 4 to the inner space of the outer tube 1 as well as that of the first embodiment.

In explanations of the aforementioned first and second embodiments, the proximity conductor is connected with one of the outer lead wires. However, the proximity conductor may be disposed adjacent to or in contact with the discharge tube so as to electrically insulate from the one of the outer wire without connecting thereto as well as that of the third embodiment.

Furthermore, in explanations of the first through third embodiments, the inert gas such as $N_2$-gas is filled into the outer tube 1. However, even when the outer tube 1 is in the exhausted state, it is possible to obtain a similar effect to those of the above-mentioned embodiments.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A metal halide lamp comprising:

a discharge tube made of a ceramic material and containing a pair of electrodes and at least metal halide as a luminescent material, a proximity conductor disposed adjacent to or in contact with said discharge tube, said discharge tube and said proximity conductor being disposed in a translucent or transparent outer tube which is exhausted or filled with an inert gas, and one end of said proximity conductor being electrically connected to a portion of an outer lead member extending out of said discharge tube, the outer lead member being connected with one of said electrodes, and the other end of said proximity conductor being disposed adjacent to said discharge tube.

2. A metal halide lamp comprising:

a discharge tube made of a ceramic material and containing a pair of electrodes and at least metal halide as a luminescent material, a proximity conductor disposed adjacent to or come in contact with said discharge tube, said discharge tube and said proximity conductor being disposed in a translucent or transparent outer tube which is exhausted or filled with an inert gas, said proximity conductor being wound around said discharge tube for supplying a current to one of said electrodes.

3. The metal halide lamp in accordance with claim 2, wherein said proximity conductor contacts an outer surface of said discharge tube at an at least one point.

4. A metal halide lamp comprising:

a discharge tube made of a ceramic material and containing a pair of electrodes and at least metal halide as a luminescent material, a proximity conductor disposed adjacent to or in contact with said discharge tube, said discharge tube and said proximity conductor being disposed in a translucent or transparent outer tube which is exhausted or filled with an inert gas, and said proximity conductor being electrically insulated from a conductive member mounted to said discharge tube, the conductive member providing an electrical potential to the discharge tube.

5. The metal halide lamp in accordance with claim 1, wherein said proximity conductor contacts an outer surface of said discharge tube at an at least one point.

6. The metal halide lamp in accordance with claim 1, wherein said metal halide contains at least one chemical element among sodium, lithium, potassium and cesium.

7. The metal halide lamp in accordance with claim 2, wherein said metal halide contains at least one chemical element among sodium, lithium, potassium and cesium.

8. The metal halide lamp in accordance with claim 4, wherein said metal halide contains at least one chemical element among sodium, lithium, potassium and cesium.

9. The metal halide lamp in accordance with claim 1, wherein a translucent tube is disposed in said outer tube, and said discharge tube and said proximity conductor are disposed in said translucent tube.

10. The metal halide lamp in accordance with claim 2, wherein a translucent tube is disposed in said outer tube, and said discharge tube and said proximity conductor are disposed in said translucent tube.

11. The metal halide lamp in accordance with claim 4, wherein a translucent tube is disposed in said outer tube, and said discharge tube and said proximity conductor are disposed in said translucent tube.

12. The metal halide lamp in accordance with claim 1, wherein a pulse voltage is applied to said pair of electrodes at the start of a lighting operation, and said pulse voltage is a peak voltage of 2.5 kV or less having a pulse width of 0.5$\mu$ second or less at 90% peak voltage.

13. The metal halide lamp in accordance with claim 2, wherein a pulse voltage is applied to said pair of electrodes at the start of a lighting operation, and said pulse voltage is a peak voltage of 2.5 kV or less having a pulse width of 0.5$\mu$ second or less at 90% peak voltage.

14. The metal halide lamp in accordance with claim 4, wherein a pulse voltage is applied to said pair of electrodes at the start of a lighting operation, and said pulse voltage is a peak voltage of 2.5 kV or less having a pulse width of 0.5$\mu$ second or less at 90% peak voltage.

* * * * *